US009901984B2

(12) United States Patent
Wang et al.

(10) Patent No.: US 9,901,984 B2
(45) Date of Patent: Feb. 27, 2018

(54) METHOD FOR PREPARING R-FE-B BASED SINTERED MAGNET

(71) Applicant: Yantai Zhenghai Magnetic Material Co., Ltd., Yantai (CN)

(72) Inventors: Qingkai Wang, Yantai (CN); Dongdong Li, Yantai (CN); Buzhuang Peng, Yantai (CN); Meizhu Shao, Yantai (CN); Rui Wei, Yantai (CN)

(73) Assignee: Yantai Zhenghai Magnetic Material Co., Ltd., Yantai (CN)

( * ) Notice: Subject to any disclaimer, the term of this patent is extended or adjusted under 35 U.S.C. 154(b) by 467 days.

(21) Appl. No.: 14/187,197

(22) Filed: Feb. 21, 2014

(65) Prior Publication Data

US 2014/0356217 A1 Dec. 4, 2014

(30) Foreign Application Priority Data

May 30, 2013 (CN) ..... 2013 1 0209364

(51) Int. Cl.
*H01F 41/02* (2006.01)
*B22F 3/24* (2006.01)
*H01F 1/057* (2006.01)

(52) U.S. Cl.
CPC ..... *B22F 3/24* (2013.01); *H01F 1/0572* (2013.01); *B22F 2003/248* (2013.01)

(58) Field of Classification Search
CPC ..... B22F 3/10; B22F 1/00; B22F 3/24; B22F 203/248; H02K 21/00; H01F 41/0266
USPC ..... 310/152; 419/29, 1; 75/255; 148/302
See application file for complete search history.

(56) References Cited

U.S. PATENT DOCUMENTS 5,641,363 A * 6/1997 Fukuno ..... B22F 3/1103 148/103
2004/0000359 A1* 1/2004 Tayu ..... H01F 41/0293 148/302
2005/0028892 A1* 2/2005 Sasaki ..... B22F 1/0007 148/302
2006/0231165 A1* 10/2006 Kato ..... H01F 1/0577 148/302

(Continued)

OTHER PUBLICATIONS

Rong et al. (Journal of Applied Physics, Feb. 2012, vol. 111, 07A717).*

*Primary Examiner* — Xiaowei Su
(74) *Attorney, Agent, or Firm* — Matthias Scholl, PC; Matthias Scholl

(57) ABSTRACT

A method for preparing an R—Fe—B based sintered magnet. The method includes: 1) preparing a $R^1$—Fe—B-M alloy, pulverizing the $R^1$—Fe—B-M alloy to yield a $R^1$—Fe—B-M alloy powder, adding a heavy rare earth powder of $R^2$ or $R^2X$ and subsequently adding a lubricant to the $R^1$—Fe—B-M alloy powder and uniformly stirring to form a mixture, where $R^1$ being Nd, Pr, Tb, Dy, La, Gd, Ho, or a mixture thereof; M being Ti, V, Cr, Mn, Co, Ga, Cu, Si, Al, Zr, Nb, W, Mo, or a mixture thereof; $R^2$ being at least one from Tb, Dy, and Ho; X being at least one from O, F, and Cl; 2) pressing the mixture obtained in step 1) to form a compact, and sintering the compact in a pressure sintering device in vacuum or in an inactive gas atmosphere to obtain a magnet; and 3) aging the magnet obtained in step 2).

3 Claims, 3 Drawing Sheets

(56) References Cited

U.S. PATENT DOCUMENTS

| | | | | |
|---|---|---|---|---|
| 2010/0003156 | A1* | 1/2010 | Suzuki | B22F 1/025<br>419/10 |
| 2011/0279205 | A1* | 11/2011 | Fukui | C22C 28/00<br>335/302 |
| 2012/0114515 | A1* | 5/2012 | Kaneko | B22F 1/0088<br>419/10 |
| 2012/0182104 | A1* | 7/2012 | Ozeki | H01F 1/086<br>335/302 |
| 2013/0068992 | A1* | 3/2013 | Hono | C21D 6/00<br>252/62.55 |

* cited by examiner

METHOD FOR PREPARING R-FE-B BASED SINTERED MAGNET

CROSS-REFERENCE TO RELATED APPLICATIONS

Pursuant to 35 U.S.C. § 119 and the Paris Convention Treaty, this application claims the benefit of Chinese Patent Application No. 201310209364.6 filed May 30, 2013, the contents of which are incorporated herein by reference. Inquiries from the public to applicants or assignees concerning this document or the related applications should be directed to: Matthias Scholl P.C., Attn.: Dr. Matthias Scholl Esq., 14781 Memorial Drive, Suite 1319, Houston, Tex. 77079.

BACKGROUND OF THE INVENTION

Field of the Invention

The invention relates to a method for preparing an R—Fe—B based sintered magnet, which belongs to the field of rare earth permanent magnet materials.

Description of the Related Art

Nd—Fe—B based sintered magnet has been widely applied because of its superb performance. The improvement of the magnetic remanence and the coercivity facilitate the fast increase of the motor market. However, a conventional method for improving the coercivity has to pay the price of sacrificing the magnetic remanence as well as investing a large amount of the heavy rare earth elements of Dy/Tb thereby resulting in a sharp increase of the production cost of the magnet. In order to decrease the amount of the heavy rare earth elements including Dy/Tb and obtain a high-temperature resistance, grain boundary diffusion and two-alloy method are mainly used to develop the magnet having a low Dy content and a high coercivity.

The grain boundary diffusion is conducted on the Dy and Tb on the magnetic surface to improve the coercivity of the sintered magnet and decrease the magnetic remanence. The grain boundary diffusion is capable of largely decreasing the use of the heavy rare earth elements and further significantly lowering the production cost of the magnet. But a main technology currently applied is the surface penetration of Dy which includes machining the magnet into a lamina, arranging Dy or Tb on the magnetic surface, and performing high temperature treatment to enable the heavy rare earth to cross the liquid phase of grain boundary and enter the internal magnet. The method has a strict requirement on the size of the magnet, and a thickness required by the process is ≤7 mm.

The binary alloy method is able to improve the concentration of Dy on the main phase surface, so that the binary alloy method is supposed to saves Dy. A main phase alloy in the binary alloy method is $Nd_2Fe_{14}B$, and a promoter alloy includes Dy and Tb. Sintered magnet prepared by mixing such the main phase alloy powder and the promoter alloy powder is able to segregate Dy on the main phase surface. If Dy segregation around the grain boundary is realized, the saturated magnetization of the sintered magnet prepared by the binary alloy method is much higher than the common sintered magnet. However, the sintering temperature in a common method is required to be higher than 1000° C. to yield a required density of the magnet, a large amount of the heavy rare earth elements at the temperature are diffused to the main phase, thereby being difficult to realizing the purpose of accumulation of heavy rare earth elements in the grain boundary zone. Therefore, the binary alloy method has the same effect as the conventional method that directly adds heavy rare earth elements during the melting stage.

Surface coating or burying methods for improving the magnet properties of R—Fe—B magnet are restricted by the size of the magnet, and a thickness of the magnet is only less than 7 mm; besides, during the coating or burying, a poor control on the thickness of the coated layer and the density easily results in a high defect rate during the bath production. While in the conventional binary alloy method, a large amount of the heavy rare earth elements enter the main phase during the heat treatment of the high temperature sintering process, so that the rich Dy and the rich Tb alloy do not function in the optimization of the microstructure of the grain boundary, and the improvement of the magnet property is not obvious.

SUMMARY OF THE INVENTION

In view of the above-described problems, it is one objective of the invention to provide a method for preparing an R—Fe—B based sintered magnet. The method of the invention is creative in that heavy rare earth powder is arranged on the grain boundary by means of adding heavy rare earth powder of $R^2$ or $R^2X$ to the $R^1$—Fe—B-M powder; raw materials are mixed to yield a uniform arrangement of the added heavy rare earth powder, pressed and shaped; a resulting compact is sintered in a pressure sintering device at a temperature lower than a common sintering temperature to yield a corresponding magnet density; and the heavy rare earth elements arranged on the grain boundary are diffused along the liquid RE-rich phase of the grain boundary by conducting a long term low temperature sintering.

To achieve the above objective, in accordance with one embodiment of the invention, there is provided a method for preparing an R—Fe—B based sintered magnet, the method comprising the following steps:

1) preparing a $R^1$—Fe—B-M alloy using a common method, pulverizing the $R^1$—Fe—B-M alloy to yield a $R^1$—Fe—B-M alloy powder, adding a heavy rare earth powder of $R^2$ or $R^2X$ and subsequently adding a lubricant to the $R^1$—Fe—B-M alloy powder and uniformly stirring to form a mixture; wherein the $R^1$—Fe—B-M alloy comprises between 27 wt. % and 33 wt. % (not including 27 wt. % and 33 wt. %) of $R^1$ being selected from the group consisting of Nd, Pr, Tb, Dy, La, Gd, Ho, and a mixture thereof; between 0.8 wt. % and 1.3 wt. % of B; and less than 5 wt. % of M being selected from the group consisting Ti, V, Cr, Mn, Co, Ga, Cu, Si, Al, Zr, Nb, W, Mo, and a mixture thereof; $R^2$ is at least one from Tb, Dy, and Ho; X is at least one from 0, F, and Cl; $R^2$ or $R^2X$ accounts for between 0.1 wt. % and 3 wt. % in total weight of the $R^1$—Fe—B-M alloy powder;

2) pressing the mixture obtained in step 1) to form a compact, and sintering the compact in a pressure sintering device in vacuum or in an inactive gas atmosphere; the sintering of the compact specifically comprising: degassing the compact in the absence of pressure at a temperature of less than 970° C. for more than 45 min, and sintering the compact by applying a pressure of between 10 and 150 Mpa at a temperature of between 800 and 970° C. to obtain a magnet having a magnetic density of larger than 7.2 g/cm$^3$; and The above temperatures is designed based on the principle that the heavy rare earth elements on a grain boundary easily enter a main phase if the temperature is higher than a certain value, however, a common sintering process performed in vacuum condition or in the inactive gas atmosphere at the temperature of less than 970° C. do not ensure a magnet contraction to yield a corresponding density, so that gaps exist in the internal magnet, the magnet performance and the service life thereof are affected. Thus, the method of the invention applies a pressure on the magnet being treated during the sintering and takes advantages of an external force to facilitate the contraction of the magnet, and the process of the magnet contraction is controlled by the sintering temperature and the pressure value.

3) aging the magnet obtained in step 2) at a temperature between 400 and 600° C. for between 60 and 480 min in the absence of pressure.

The raw materials are prevented from contacting with oxygen as much as possible during the preparation, because that too high an oxygen content affects the formation of a liquid phase of the grain boundary and is not beneficial for the diffusion of the heavy rare earth elements along the grain boundary. Furthermore, a large amount of oxygen is brought in when using the addition of the oxides of the heavy rare earth, so that the oxygen is strictly controlled and prevented from entering during the whole process, the oxygen content in the magnet prepared is controlled at between 1000 and 7000 ppm, a carbon content is controlled at less than 1500 ppm, and a nitrogen content is controlled at less than 1200 ppm.

In a class of this embodiment, the common method for preparing the $R^1$—Fe—B-M alloy is employed and specifically comprises: melting raw materials at a certain ratio into a melt, and pouring the melt to a quenching roller to form scales having a thickness of between 0.1 and 0.7 mm. The rare earth phase is obviously abundant in the metallographic grain boundary of the scale.

In a class of this embodiment, the heavy rare earth powder of $R^2$ or $R^2X$ in step 1) has a particle size of less than or equal to 100 μm and comprises between 0 and 40 wt. % of X.

In a class of this embodiment, the particle size of the heavy rare earth powder of $R^2$ or $R^2X$ in step 1) is preferably between 0.01 and 2 μm. The design can avoid a too large particle size of the heavy rare earth powder arranged on the grain boundary from forming an anti-magnetic field due to defects occurring on the grain boundary thereby affecting the magnetic performance.

In a class of this embodiment, the addition of the lubricant in step 1) accounts for between 0.05 and 0.3 wt. % in total weight of the $R^1$—Fe—B-M alloy powder and the heavy rare earth powder of $R^2$ or $R^2X$. The design can uniformly disperse the heavy rare earth powder by adding corresponding lubricant to the raw materials.

In a class of this embodiment, the pressure applied in step 2) is increased slowly by less than 10 Megapascal/min. The design can prevent the distortion of the magnetic grain because of the instantaneous pressure.

Advantages of the invention are summarized as follows:

In the method, the heavy rare earth powder of $R^2$ or $R^2X$ are added to the $R^1$—Fe—B-M alloy powder, and the resulting mixture is pressed for shaping, thereby realizing the arrangement of the heavy rare earth powder on the grain boundary (as shown in FIG. 1). After that, the compact is processed for heat treatment using pressure sintering, during which, the sintering temperature is controlled below a common sintering temperature to ensure a corresponding magnetic density by the sintering as well as preventing the heavy rare earth elements from entering the main phase of the magnet due to too high temperature, so that the heavy rare earth elements on the grain boundary are diffused along the surface of the grain in a liquid RE-rich phase on the grain boundary (as shown in FIG. 2) to form an epitaxial layer of the high heavy rare earth elements, the grain boundary of the main phase is magnetically hardened, the scattered field of the grain boundary of the main phase is decreased, and the magnetic exchange coupling is attenuated, thereby realizing the effect of the optimization of the microstructure of the grain boundary. The process largely improves the magnet performance, has a low production cost, is free from the restriction of the size of the magnet and highly controllable during the whole production process.

BRIEF DESCRIPTION OF THE DRAWINGS

The invention is described hereinbelow with reference to the accompanying drawings, in which.

Figure 1:
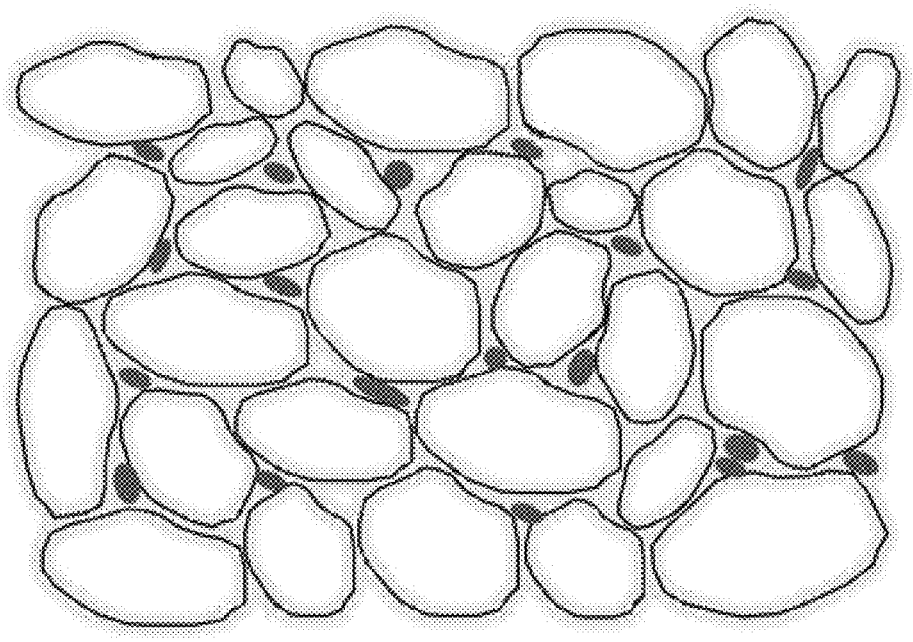
FIG. 1 is a cross sectional view of a compact.
Figure 2:
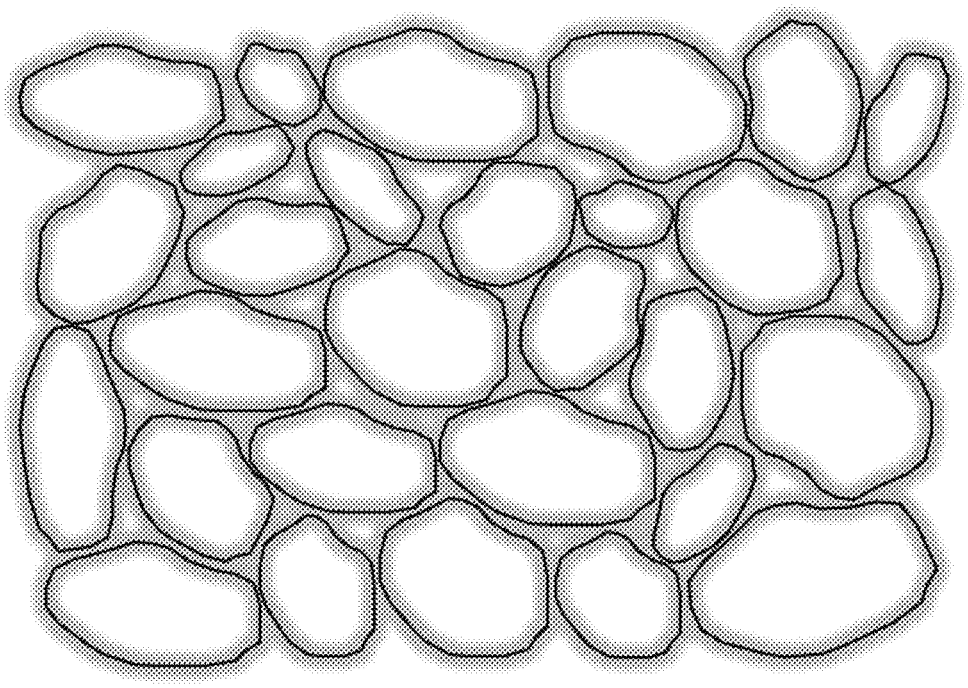
FIG. 2 is a cross sectional view of a microstructure of a magnet after a whole sintering process.

In the drawings, the following reference numbers are used: 1. Upper and lower pressure head; 2. Mold cavity; 3. Heating chamber; 4. Compact.

DETAILED DESCRIPTION OF THE EMBODIMENTS

For further illustrating the invention, experiments detailing a method for preparing an R—Fe—B based sintered magnet are described below. It should be noted that the following examples are intended to describe and not to limit the invention.

Example 1

Raw materials at a certain ratio were melted in a vacuum melting furnace in an argon atmosphere to form a $R^1$—Fe—B-M alloy scale having a thickness of between 0.1 and 0.5 mm. The scale comprised: 5.69 wt. % of Pr, 18.22 wt. % of Nd, 6.18 wt. % of Dy, 0.98 wt. % of B, 1.51 wt. % of Co, 0.1 wt. % of Ga, 0.29 wt. % of Al, that is, the content of $R^1$ accounted for 30.09 wt. % in total. The $R^1$—Fe—B-M alloy scale was pulverized by hydrogen decrepitation and jet milling to yield a powder having a particle size of 3.3 μm. A heavy rare earth powder of $R^2$ being Dy powder was added, and an average particle size of the Dy powder was 0.9 μm. 10 Kg of $R^1$—Fe—B-M jet milled powder was added with 0.1 Kg of Dy powder for mixing for 3 hr, and added with 0.15 wt. % of a lubricant for mixing for another 3 hr. Thereafter, a resulting mixture was pressed for shaping using a 15 KOe magnetic field orientation to yield a compact having a density of 3.95 g/cm$^3$.

Figure 3:
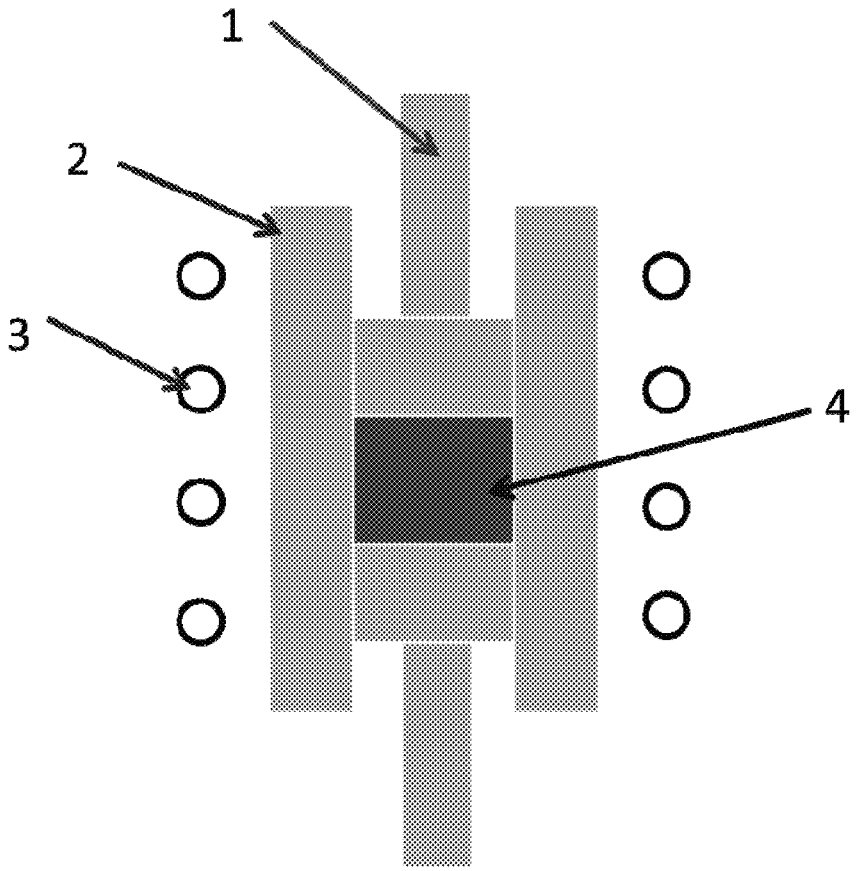
FIG. 3 is a structure diagram of a pressure sintering device in Example 1.

The compact was transferred to a pressure sintering device for vacuum sintering; a heating rate was controlled at 9° C./min during the whole heating process of the vacuum sintering. The vacuum sintering was specifically conducted as follows: the compact was firstly degassed at a temperature of 400° C. for 120 min and a temperature of 850° C. for 200 min, respectively, and was then sintered in the pressure sintering device in an inactive gas atmosphere to form a corresponding density. The pressure sintering device comprised: an upper and lower pressure head 1, a mold cavity 2, a heating chamber 3, and a compact 4 (as shown in FIG. 3). The pressure sintering temperature was controlled at 930° C., a pressure applied was 105 Megapascal, a holding time for the pressure sintering lasted for 30 min, a pressure growth was controlled at 5 Megapascal/min, and a resulting product was quenched to the room temperature after the holding time. Thereafter, the product was maintained at a temperature of 900° C. for 240 min in the absence of pressure. Finally, the product was processed with aging treatment for optimizing the microstructure at an aging temperature of 480° C. for an aging time of 300 min, and then quenched to the room temperature. Comparisons of magnetic property between magnet $M_1$ prepared by the process of the Example and magnet $M_2$ prepared by a common method based on the same content of heavy rare earth element was shown in Table 1.

TABLE 1

| Magnetic property of $M_1$ and $M_2$ | | | | | |
|---|---|---|---|---|---|
| | Density | Br | Hcj | (BH) max | Hk/Hcj |
| | Unit | | | | |
| Item | (g/cm$^3$) | kGs | kOe | MGOe | — |
| $M_2$ of contrast example | 7.63 | 12.39 | 26.57 | 37.63 | 0.91 |
| $M_1$ of Example 1 | 7.63 | 12.21 | 31.63 | 36.78 | 0.90 |

Example 2

Raw materials at a certain ratio were melted in a vacuum melting furnace in an argon atmosphere to form a $R^1$—Fe—B-M alloy scale having an obvious metallurgical grain boundary and a thickness of between 0.1 and 0.5 mm. The scale comprised: 4.72 wt. % of Pr, 25.67 wt. % of Nd, 0.52 wt. % of Dy, 0.97 wt. % of B, 0.9 wt. % of Co, 0.1 wt. % of Ga, 0.1 wt. % of Al, that is, the content of $R^1$ accounted for 30.91 wt. % in total. The $R^1$—Fe—B-M alloy scale was mechanically ground into a powder having a diameter of less than 2 mm, and was then ball-milled to form particles having an average particle size of 6 μm. A heavy rare earth powder of $R^2$ being Tb powder was added, an addition of the Tb powder accounted for 0.4 wt. % in total weight, and an average particle size of the Tb powder was 1.8 μm. The above $R^1$—Fe—B-M powder and the Tb powder was mixed and ball-milled for 360 min for fully mixing the two. Thereafter, a resulting mixture was pressed for shaping using a 15 KOe magnetic field orientation. The compact was transferred to a pressure sintering device for degassing. The degassing of the compact was conducted at a temperature of 400° C. for 120 min and a temperature of 800° C. for 200 min, respectively. After the degassing treatment, pressure sintering was performed to produce a corresponding density, a pressure sintering temperature was controlled at 950° C., a pressure applied was 98 Megapascal, a holding time for the pressure sintering lasted for 30 min, and a resulting product was quenched to the room temperature after the holding time. Thereafter, the product was maintained at a temperature of 930° C. for 150 min. Finally, the product was process with aging treatment at an aging temperature of 500° C. for an aging time of 300 min. Comparisons of magnetic property between magnet $M_3$ prepared by the process of the Example and magnet $M_4$ prepared by a common method based on the same content of heavy rare earth element was shown in Table 2.

TABLE 2

| Magnetic property of $M_3$ and $M_4$ | | | | | |
|---|---|---|---|---|---|
| | Density | Br | Hcj | (BH) max | Hk/Hcj |
| | Unit | | | | |
| Item | (g/cm$^3$) | kGs | kOe | MGOe | — |
| $M_4$ of Contrast example | 7.56 | 14.09 | 13.46 | 47.09 | 0.97 |
| $M_3$ of Example 2 | 7.56 | 13.85 | 18.71 | 46.23 | 0.94 |

Example 3

Raw materials at a certain ratio were melted in a vacuum melting furnace in vacuum or in an inactive gas atmosphere to form a $R^1$—Fe—B-M alloy scale having a thickness of between 0.1 and 0.5 mm. The scale comprised: 4.72 wt. % of Pr, 25.67 wt. % of Nd, 0.52 wt. % of Dy, 0.97 wt. % of B, 0.9 wt. % of Co, 0.1 wt. % of Ga, 0.1 wt. % of Al, that is, a content of $R^1$ accounted for 30.91 wt. % in total. The $R^1$—Fe—B-M alloy scale was pulverized by hydrogen decrepitation and jet milling to yield a powder having a particle size of 3.2 μm. A heavy rare earth powder of $R^2$ or $R^2X$ being a mixed powder of Dy and $Dy_2O_3$ was added, and an average particle size of the mixed powder of Dy and $Dy_2O_3$ was 0.9 μm. It was known from analysis that the mixed powder was composed of 93.55 wt. % of Dy and 6.45 wt. % of 0. A content of the mixed powder accounted for 1.6 wt. % of the total weight. The $R^1$—Fe—B-M alloy scale powder and the mixed powder of Dy and $Dy_2O_3$ were mixed for 3 hr and subsequently mixed for another 3 hr after being added with 0.15 wt. % of a lubricant. Thereafter, a resulting mixture was pressed for shaping using a 15 KOe magnetic field orientation to yield a compact having a density of 3.95 g/cm$^3$.

The compact was transferred to a pressure sintering device for vacuum sintering; a heating rate was controlled at 9° C./min during the whole heating process of the vacuum sintering. The vacuum sintering was specifically conducted as follows: the compact was firstly degassed at a temperature of 400° C. for 120 min and a temperature of 850° C. for 200 min, respectively. After that, between 5 and 10 KPa of argon was charged, and the compact was then sintered in the pressure sintering device in the argon atmosphere. A pressure sintering temperature was controlled at 910° C., a pressure applied was 115 Megapascal, a holding time for the pressure sintering lasted for 30 min, a pressure growth was controlled at 5 Megapascal/min, and a resulting product was quenched to the room temperature after the holding time, and a magnetic density was 7.42 g/cm$^3$. Thereafter, the product was maintained at a temperature of 900° C. for 120 min in the absence of pressure for further optimizing the particle size. Finally, the product was processed with aging treatment for optimizing the microstructure at an aging temperature of 500° C. for an aging time of 300 min, and then quenched to the room temperature. Comparisons of magnetic property between magnet $M_5$ prepared by the process of the Example and magnet $M_6$ prepared by a common method based on the same content of heavy rare earth element was shown in Table 3.

TABLE 3

| Magnetic property of $M_5$ and $M_6$ | | | | | |
|---|---|---|---|---|---|
| | Density | Br | Hcj | (BH) max | Hk/Hcj |
| | Unit | | | | |
| Item | ($g/cm^3$) | kGs | kOe | MGOe | — |
| $M_6$ of Contrast example | 7.56 | 14.09 | 13.46 | 47.09 | 0.97 |
| $M_5$ of Example 3 | 7.57 | 13.88 | 19.13 | 46.17 | 0.93 |

Example 4

A first step: raw materials at a certain ratio were melted in a vacuum melting furnace in vacuum or in an inactive gas atmosphere to form a $R^1$—Fe—B-M alloy scale having a thickness of between 0.1 and 0.5 mm. The scale comprised: 5.88 wt. % of Pr, 22.4 wt. % of Nd, 0.7 wt. % of Dy, 0.5 wt. % of Tb, 0.99 wt. % of B, 0.6 wt. % of Co, 0.15 wt. % of Ga, 0.1 wt. % of Al, that is, a content of $R^1$ accounted for 29.48 wt. % in total. The $R^1$—Fe—B-M alloy scale was pulverized by hydrogen decrepitation and jet milling to yield a powder having a particle size of 3.1 μm. A heavy rare earth powder of $R^2$ and $R^2X$ being a mixed powder of $DyF_3$ and $Dy_2O_3$ at a ratio of 1:1 were added, and an average particle size of the mixed powder of $DyF_3$ and $Dy_2O_3$ was 0.8 μm. A content of the mixed powder accounted for 0.5 wt. % of the total weight. The $R^1$—Fe—B-M alloy scale powder and the mixed powder of $DyF_3$ and $Dy_2O_3$ were mixed for 3 hr and subsequently mixed for another 3 hr after being added with 0.15 wt. % of a lubricant. Thereafter, a resulting mixture was pressed for shaping using a 15 KOe magnetic field orientation to yield a compact having a density of 3.95 $g/cm^3$.

A second step: the compact was transferred to a pressure sintering device for vacuum sintering, the compact was degassed at a temperature of 400° C. for 120 min and a temperature of 800° C. for 240 min, respectively. After that, the compact was sintered in the pressure sintering device to yield a corresponding density. A pressure sintering temperature was controlled at 920° C., a pressure applied was 110 Megapascal, a holding time for the pressure sintering lasted for 30 min, and a resulting product was quenched to the room temperature after the holding time.

A third step: the product was maintained at a temperature of 900° C. for 150 min in the absence of pressure for further optimizing the particle size. Finally, the product was aged at a temperature of 490° C. for 300 min. Comparisons of magnetic property between magnet $M_7$ prepared by the process of the Example and magnet Mg prepared by a common method based on the same content of heavy rare earth element was shown in Table 4.

TABLE 4

| Magnetic property of $M_8$ and $M_7$ | | | | | |
|---|---|---|---|---|---|
| | Density | Br | Hcj | (BH) max | Hk/Hcj |
| | Unit | | | | |
| Item | ($g/cm^3$) | kGs | kOe | MGOe | — |
| $M_8$ of Contrast example | 7.57 | 14.31 | 15.42 | 48.73 | 0.99 |
| $M_7$ of Example 4 | 7.58 | 14.04 | 20.92 | 47.61 | 0.94 |

Unless otherwise indicated, the numerical ranges involved in the invention include the end values.

While particular embodiments of the invention have been shown and described, it will be obvious to those skilled in the art that changes and modifications may be made without departing from the invention in its broader aspects, and therefore, the aim in the appended claims is to cover all such changes and modifications as fall within the true spirit and scope of the invention.

The invention claimed is:

1. A method for preparing an R—Fe—B based sintered magnet, the method comprising:

1) preparing an $R^1$—Fe—B-M alloy, pulverizing the $R^1$—Fe—B-M alloy to yield an $R^1$—Fe—B-M alloy powder, adding a powder of heavy rare earth metal $R^2$ and subsequently adding a lubricant to the $R^1$—Fe—B-M alloy powder and stirring to form a uniform mixture, wherein the $R^1$—Fe—B-M alloy comprises between 27 wt. % and 33 wt. % (not including 27 wt. % and 33 wt. %) of $R^1$ being at least one selected from the group consisting of Nd, Pr, Tb, Dy, La, Gd, and Ho; between 0.8 wt. % and 1.3 wt. % of B; and less than 5 wt. % of M being at least one selected from the group consisting of Ti, V, Cr, Mn, Co, Ga, Cu, Si, Al, Zr, Nb, W, and Mo; $R^2$ is at least one selected from the group consisting of Tb, Dy, and Ho; and the $R^2$ accounts for between 0.1 wt. % and 3 wt. % in total weight of the $R^1$—Fe—B-M alloy powder;

2) pressing the mixture obtained in step 1) to form a compact, and sintering the compact in a pressure sintering device in vacuum or in an inert gas atmosphere; the sintering of the compact comprising: degassing the compact in vacuum at a temperature of less than 970° C. for more than 45 min, and sintering the compact by applying a pressure of between 10 and 150 Megapascal at a temperature of between 930 and 970° C. to obtain a magnet having a magnet density of larger than 7.2 $g/cm^3$, wherein the pressure applied in sintering the compact is obtained by increasing pressure at a rate less than 10 Megapascal/min; and 3) aging the magnet obtained in step 2) at a temperature between 400 and 600° C. for between 60 and 480 min in vacuum.

2. The method of claim 1, wherein the powder of heavy rare earth metal $R^2$ in step 1) has a particle size of less than or equal to 100 μm.

3. The method of claim 1, wherein the magnet obtained in step 3) comprises 1000 to 7000 ppm of oxygen, less than 1500 ppm of carbon, and less than 1200 ppm of nitrogen with respect to a weight of the magnet.

* * * * *